US008219389B2

(12) United States Patent
Hetherington et al.

(10) Patent No.: US 8,219,389 B2
(45) Date of Patent: Jul. 10, 2012

(54) SYSTEM FOR IMPROVING SPEECH INTELLIGIBILITY THROUGH HIGH FREQUENCY COMPRESSION

(75) Inventors: Phillip A. Hetherington, Port Moody (CA); Xueman Li, Barneley (CA)

(73) Assignee: QNX Software Systems Limited, Kanata, Ontario (CA)

( * ) Notice: Subject to any disclaimer, the term of this patent is extended or adjusted under 35 U.S.C. 154(b) by 0 days.

(21) Appl. No.: 13/336,149

(22) Filed: Dec. 23, 2011

(65) Prior Publication Data

US 2012/0095759 A1 Apr. 19, 2012

Related U.S. Application Data

(63) Continuation of application No. 11/298,053, filed on Dec. 9, 2005, now Pat. No. 8,086,451, which is a continuation-in-part of application No. 11/110,556, filed on Apr. 20, 2005, now Pat. No. 7,813,931.

(51) Int. Cl.
*G10L 21/00* (2006.01)
*G10L 19/14* (2006.01)

(52) U.S. Cl. ..... 704/201; 704/205; 704/226; 381/316; 381/321

(58) Field of Classification Search ..... 704/201, 704/205, 226; 381/316, 321
See application file for complete search history.

(56) References Cited

U.S. PATENT DOCUMENTS 4,130,734 A 12/1978 Lee
4,170,719 A 10/1979 Fujimur
4,255,620 A 3/1981 Harris et al.
4,343,005 A 8/1982 Han et al.
4,374,304 A 2/1983 Flanagan
4,600,902 A 7/1986 Lafferty
4,630,305 A 12/1986 Borth et al.
4,700,360 A 10/1987 Visser
4,741,039 A 4/1988 Bloy
4,953,182 A 8/1990 Chung
5,335,069 A 8/1994 Kim
5,345,200 A 9/1994 Reif
5,396,414 A 3/1995 Alcone
5,416,787 A 5/1995 Kodama et al.
5,455,888 A 10/1995 Iyengar et al.
5,471,527 A 11/1995 Ho et al.

(Continued)

FOREIGN PATENT DOCUMENTS

EP 0 054 450 A1 6/1982

(Continued)

OTHER PUBLICATIONS

"Neural Networks Versus Codebooks in an Application for Bandwidth Extension of Speech Signals" by Bernd Iser, Gerhard Schmidt, Temic Speech Dialog System, Soeflinger Str. 100, 89077 Ulm, Germany, Proceedings of Eurospeech 2003 (16 Pages).

(Continued)

*Primary Examiner* — Jialong He
(74) *Attorney, Agent, or Firm* — Brinks Hofer Gilson & Lione

(57) ABSTRACT

A speech enhancement system that improves the intelligibility and the perceived quality of processed speech includes a frequency transformer and a spectral compressor. The frequency transformer converts speech signals from the time domain to the frequency domain. The spectral compressor compresses a pre-selected portion of the high frequency band and maps the compressed high frequency band to a lower band limited frequency range.

21 Claims, 5 Drawing Sheets

U.S. PATENT DOCUMENTS

| | | | |
|---|---|---|---|
| 5,497,090 | A | 3/1996 | Macovski |
| 5,581,652 | A | 12/1996 | Abe et al. |
| 5,715,363 | A | 2/1998 | Tamura et al. |
| 5,771,299 | A | 6/1998 | Melanson |
| 5,774,841 | A | 6/1998 | Salazar et al. |
| 5,790,671 | A | 8/1998 | Cooper |
| 5,822,370 | A | 10/1998 | Graupe |
| 5,828,756 | A | 10/1998 | Benesty et al. |
| 5,867,815 | A | 2/1999 | Kondo et al. |
| 5,950,153 | A | 9/1999 | Ohmori et al. |
| 5,999,899 | A | 12/1999 | Robinson |
| 6,115,363 | A | 9/2000 | Oberhammer et al. |
| 6,144,244 | A | 11/2000 | Gilbert |
| 6,154,643 | A | 11/2000 | Cox |
| 6,157,682 | A | 12/2000 | Oberhammer |
| 6,195,394 | B1 | 2/2001 | Arbeiter et al. |
| 6,208,958 | B1 | 3/2001 | Cho et al. |
| 6,226,616 | B1 | 5/2001 | You et al. |
| 6,275,596 | B1 | 8/2001 | Fretz et al. |
| 6,295,322 | B1 | 9/2001 | Arbeiter et al. |
| 6,311,153 | B1 | 10/2001 | Nakatoh et al. |
| 6,504,935 | B1 | 1/2003 | Jackson |
| 6,523,003 | B1 | 2/2003 | Chandran et al. |
| 6,539,355 | B1 | 3/2003 | Omori et al. |
| 6,577,739 | B1 | 6/2003 | Hurtig et al. |
| 6,615,169 | B1 | 9/2003 | Ojala et al. |
| 6,675,144 | B1 | 1/2004 | Tucker et al. |
| 6,680,972 | B1 | 1/2004 | Lijeryd et al. |
| 6,681,202 | B1 | 1/2004 | Miet et al. |
| 6,691,083 | B1 | 2/2004 | Breen |
| 6,691,085 | B1 | 2/2004 | Rotola-Pukkila et al. |
| 6,704,711 | B2 | 3/2004 | Gustafsson et al. |
| 6,721,698 | B1 | 4/2004 | Hariharan et al. |
| 6,741,966 | B2 | 5/2004 | Romesburg |
| 6,766,292 | B1 | 7/2004 | Chandran et al. |
| 6,778,966 | B2 | 8/2004 | Bizjak |
| 6,819,275 | B2 | 11/2004 | Reefman et al. |
| 6,895,375 | B2 | 5/2005 | Malah et al. |
| 7,062,040 | B2 | 6/2006 | Faller |
| 7,069,212 | B2 | 6/2006 | Tanaka et al. |
| 7,139,702 | B2 | 11/2006 | Tsushima et al. |
| 7,248,711 | B2 | 7/2007 | Allegro et al. |
| 7,283,967 | B2 | 10/2007 | Nishio et al. |
| 7,333,618 | B2 | 2/2008 | Shuttleworth et al. |
| 7,333,930 | B2 | 2/2008 | Baumgarte |
| 2002/0107593 | A1 | 8/2002 | Rabipour et al. |
| 2002/0111796 | A1 | 8/2002 | Nemoto |
| 2002/0128839 | A1 | 9/2002 | Lindgren et al. |
| 2002/0138268 | A1 | 9/2002 | Gustafsson |
| 2003/0009327 | A1 | 1/2003 | Nilsson et al. |
| 2003/0050786 | A1 | 3/2003 | Jax et al. |
| 2003/0055636 | A1 | 3/2003 | Katuo et al. |
| 2003/0093278 | A1 | 5/2003 | Malah |
| 2003/0093279 | A1 | 5/2003 | Malah et al. |
| 2003/0158726 | A1 | 8/2003 | Philippe et al. |
| 2004/0022404 | A1 | 2/2004 | Negishi |
| 2004/0057574 | A1 | 3/2004 | Faller |
| 2004/0158458 | A1 | 8/2004 | Sluijter et al. |
| 2004/0166820 | A1 | 8/2004 | Sluijter et al. |
| 2004/0170228 | A1 | 9/2004 | Vadde |
| 2004/0172242 | A1 | 9/2004 | Seligman et al. |
| 2004/0174911 | A1 | 9/2004 | Kim et al. |
| 2004/0175010 | A1 | 9/2004 | Allegro et al. |
| 2004/0181393 | A1 | 9/2004 | Baumgarte |
| 2004/0190734 | A1 | 9/2004 | Kates |
| 2004/0264610 | A1 | 12/2004 | Marro et al. |
| 2004/0264721 | A1 | 12/2004 | Allegro et al. |
| 2005/0047611 | A1 | 3/2005 | Mao |
| 2005/0159944 | A1 | 7/2005 | Beerends |
| 2005/0175194 | A1 | 8/2005 | Anderson |
| 2005/0195988 | A1 | 9/2005 | Tashev et al. |
| 2005/0261893 | A1 | 11/2005 | Toyama et al. |
| 2005/0286713 | A1 | 12/2005 | Gunn et al. |
| 2006/0098810 | A1 | 5/2006 | Kim |
| 2007/0198268 | A1 | 8/2007 | Hennecke |
| 2007/0280472 | A1 | 12/2007 | Stokes, III et al. |
| 2007/0282602 | A1 | 12/2007 | Fujishima et al. |

FOREIGN PATENT DOCUMENTS

| | | | |
|---|---|---|---|
| EP | 0 497 050 | A3 | 8/1992 |
| EP | 0 706 299 | A3 | 10/1998 |
| GB | 1 424 133 | | 2/1976 |
| JP | 59-122135 | | 7/1984 |
| JP | 06-303166 | | 10/1994 |
| JP | 07-147566 | | 6/1995 |
| JP | 08-321792 | | 12/1996 |
| JP | 06-164520 | | 6/1997 |
| JP | 10-124098 | | 5/1998 |
| JP | 2001-196934 | | 7/2001 |
| JP | 2001-521648 | | 11/2001 |
| JP | 2002-073088 | | 3/2002 |
| JP | 2002-244686 | A | 8/2002 |
| KR | 10-1998-0073078 | A | 5/1998 |
| KR | 10-2002-0024742 | A | 4/2002 |
| KR | 10-2002-0066921 | A | 8/2002 |
| WO | WO 98/06090 | A1 | 2/1998 |
| WO | WO 99/14986 | | 3/1999 |
| WO | WO 01/18960 | A1 | 3/2001 |
| WO | WO 2005-004111 | A1 | 1/2005 |
| WO | WO 2005/015952 | A1 | 2/2005 |

OTHER PUBLICATIONS

Kellermann, W., Strategies for Combining Acoustic Echo Cancellation and Adaptive Beamforming Microphone Arrays, IEEE, 1997, pp. 219-222.

"A Closer Look into MPEA-4 High Efficiency AAC" Convention Paper, by Martin Wolters, Kristofer Kjörling, Daniel Homm, and Heiko Purnhagen, Audio Engineering Society, Presented at the 115$^{th}$ Convention, Oct. 10-13, 2003, New York, NY, USA (16 Pages).

Patrick, P.J., et al., "Frequency Compression of 7.6 kHz Speech into 3.3 kHz Bandwidth," *IEEE Trans. Commun.*, vol. COM-31, No. 5, May 1983, pp. 692-701.

SYSTEM FOR IMPROVING SPEECH INTELLIGIBILITY THROUGH HIGH FREQUENCY COMPRESSION

PRIORITY CLAIM

This application is a continuation of U.S. application Ser. No. 11/298,053 "System for Improving Speech Intelligibility Through High Frequency Compression," filed Dec. 9, 2005 now U.S. Pat. No. 8,086,451, which is a continuation-in-part of U.S. application Ser. No. 11/110,556 "System for Improving Speech Quality and Intelligibility," filed Apr. 20, 2005 now U.S. Pat. No. 7,813,931. The disclosure of each of the above applications is incorporated herein by reference.

BACKGROUND OF THE INVENTION

1. Technical Field

The invention relates to communication systems, and more particularly, to systems that improve the intelligibility of speech.

2. Related Art

Many communication devices acquire, assimilate, and transfer speech signals. Speech signals pass from one system to another through a communication medium. All communication systems, especially wireless communication systems, suffer bandwidth limitations. In some systems, including some telephone systems, the clarity of the voice signals depend on the systems ability to pass high and low frequencies. While many low frequencies may lie in a pass band of a communication system, the system may block or attenuate high frequency signals, including the high frequency components found in some unvoiced consonants.

Some communication devices may overcome this high frequency attenuation by processing the spectrum. These systems may use a speech/silence switch and a voiced/unvoiced switch to identify and process unvoiced speech. Since transitions between voiced and unvoiced segments may be difficult to detect, some systems are not reliable and may not be used with real-time processes, especially systems susceptible to noise or reverberation. In some systems, the switches are expensive and they create artifacts that distort the perception of speech.

Therefore, there is a need for a system that improves the perceptible sound of speech in a limited frequency range.

SUMMARY

A speech enhancement system improves the intelligibility of a speech signal. The system includes a frequency transformer and a spectral compressor. The frequency transformer converts speech signals from time domain into frequency domain. The spectral compressor compresses a pre-selected portion of the high frequency band and maps the compressed high frequency band to a lower band limited frequency range.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Enhancement logic improves the intelligibility of processed speech. The logic may identify and compress speech segments to be processed. Selected voiced and/or unvoiced segments may be processed and shifted to one or more frequency bands. To improve perceptual quality, adaptive gain adjustments may be made in the time or frequency domains. The system may adjust the gain of some or the entire speech segments. The versatility of the system allows the logic to enhance speech before it is passed to a second system in some applications. Speech and audio may be passed to an Automatic Speech Recognition (ASR) engine wirelessly or through a communication bus that may capture and extract voice in the time and/or frequency domains.

Any bandlimited device may benefit from these systems. The systems may be built into, may be a unitary part of, or may be configured to interface any bandlimited device. The systems may be a part of or interface radio applications such as air traffic control devices (which may have similar bandlimited pass bands), radio intercoms (mobile or fixed systems for crews or users communicating with each other), and Bluetooth enabled devices, such as headsets, that may have a limited bandwidth across one or more Bluetooth links. The system may also be a part of other personal or commercial limited bandwidth communication systems that may interface vehicles, commercial applications, or devices that may control user's homes (e.g., such as a voice control.)

In some alternatives, the systems may precede other processes or systems. Some systems may use adaptive filters, other circuitry or programming that may disrupt the behavior of the enhancement logic. In some systems the enhancement logic precedes and may be coupled to an echo canceller (e.g., a system or process that attenuates or substantially attenuates an unwanted sound). When an echo is detected or processed, the enhancement logic may be automatically disabled or mitigated and later enabled to prevent the compression and mapping, and in some instances, a gain adjustment of the echo. When the system precedes or is coupled to a beamformer, a controller or the beamformer (e.g., a signal combiner) may control the operation of the enhancement logic (e.g., automatically enabling, disabling, or mitigating the enhancement logic). In some systems, this control may further suppress distortion such as multi-path distortion and/or co-channel interference. In other systems or applications, the enhancement logic is coupled to a post adaptive system or process. In some applications, the enhancement logic is controlled or interfaced to a controller that prevents or minimizes the enhancement of an undesirable signal.

Figure 1:
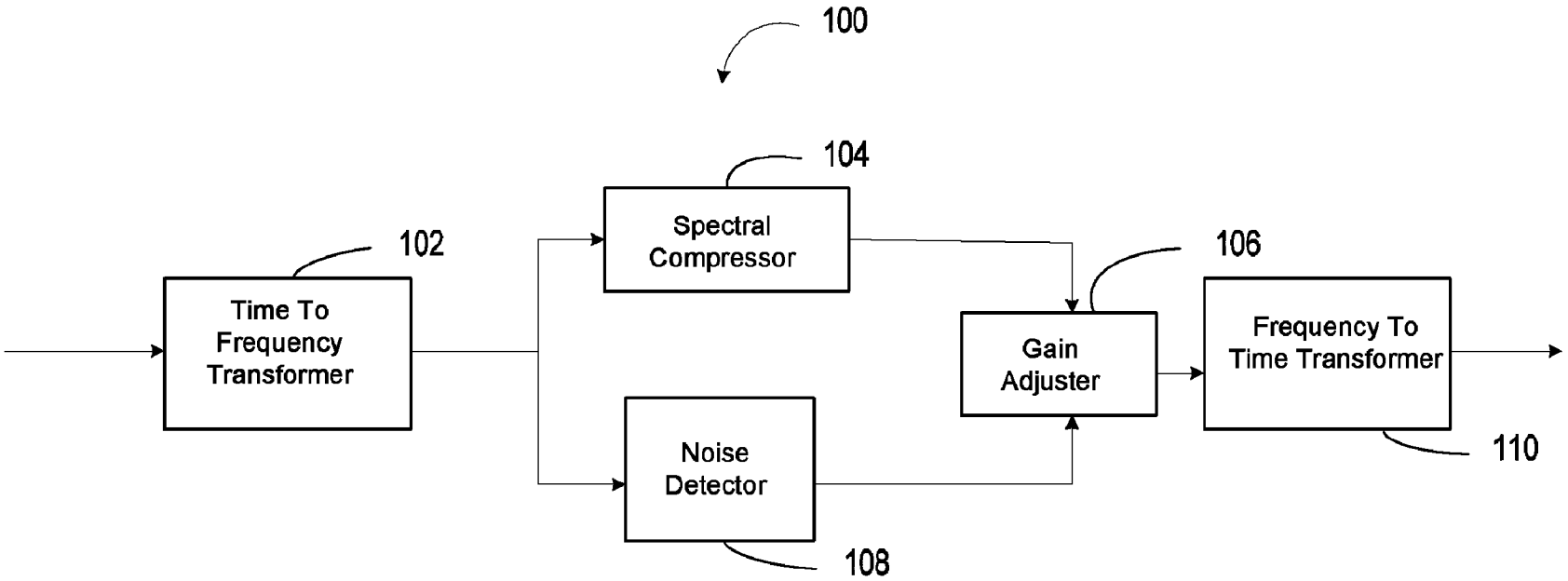
FIG. 1 is a block diagram of a speech enhancement system.

FIG. 1 is a block diagram of enhancement logic 100. The enhancement logic 100 may encompass hardware and/or software capable of running on or interfacing one or more operating systems. In the time domain, the enhancement logic 100 may include transform logic and compression logic. In FIG. 1, the transform logic comprises a frequency transformer 102. The frequency transformer 102 provides a time to frequency transform of an input signal. When received, the frequency transformer is programmed or configured to convert the input signal into its frequency spectrum. The frequency transformer may convert an analog audio or speech signal into a programmed range of frequencies in delayed or real time. Some frequency transformers 102 may comprise a set of narrow bandpass filters that selectively pass certain frequencies while eliminating, minimizing, or dampening frequencies that lie outside of the pass bands. Other enhancement systems 100 use frequency transformers 102 programmed or configured to generate a digital frequency spectrum based on a Fast Fourier Transform (FFT). These frequency transformers 102 may gather signals from a selected range or an entire frequency band to generate a real time, near real time or delayed frequency spectrum. In some enhancement systems, frequency transformers 102 automatically detect and convert audio or speech signals into a programmed range of frequencies.

The compression logic comprises a spectral compression device or spectral compressor 104. The spectral compressor 104 maps a wide range of frequency components within a high frequency range to a lower, and in some enhancement systems, narrower frequency range. In FIG. 1, the spectral compressor 104 processes an audio or speech range by compressing a selected high frequency band and mapping the compressed band to a lower band limited frequency range. When applied to speech or audio signals transmitted through a communication band, such as a telephone bandwidth, the compression transforms and maps some high frequency components to a band that lies within the telephone or communication bandwidth. In one enhancement system, the spectral compressor 104 maps the frequency components between a first frequency and a second frequency almost two times the highest frequency of interest to a shorter or smaller band limited range. In these enhancement systems, the upper cutoff frequency of the band limited range may substantially coincide with the upper cutoff frequency of a telephone or other communication bandwidth.

Figure 2:
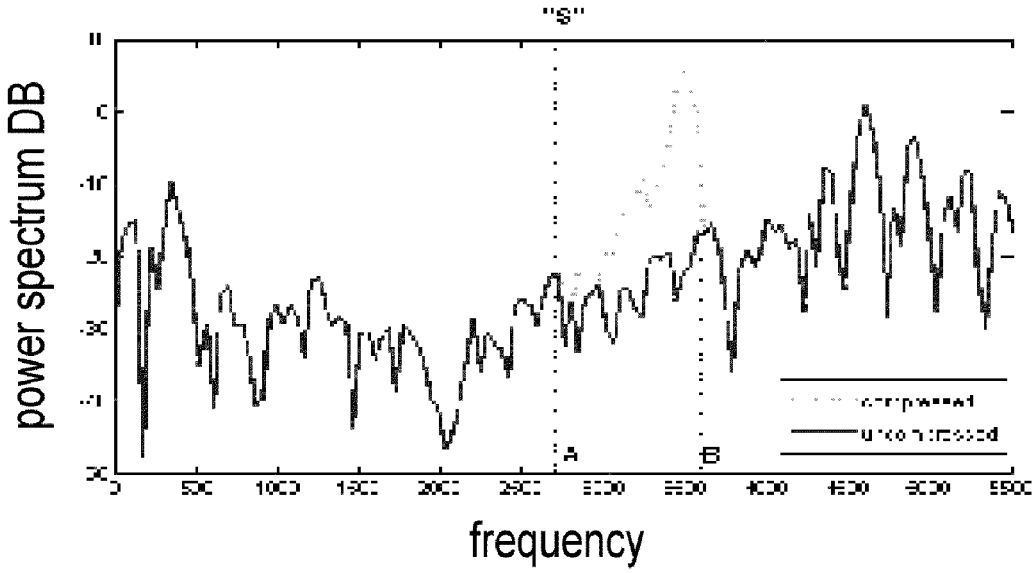
FIG. 2 is graph of uncompressed and compressed signals.

In FIG. 2, the spectral compressor 104 shown in FIG. 1 compresses and maps the frequency components between a designated cutoff frequency "A" and a Nyquist frequency to a band limited range that lies between cutoff frequencies "A" and "B." As shown, the compression of an unvoiced consonant (here the letter "S") that lies between about 2,800 Hz and about 5,550 Hz is compressed and mapped to a frequency range bounded by about 2,800 Hz and about 3,600 Hz. The frequency components that lie below cutoff frequency "A" are unchanged or are substantially unchanged. The bandwidth between about 0 Hz and about 3,600 Hz may coincide with the bandwidth of a telephone system or other communication systems. Other frequency ranges may also be used that coincide with other communication bandwidths.

Figure 3:
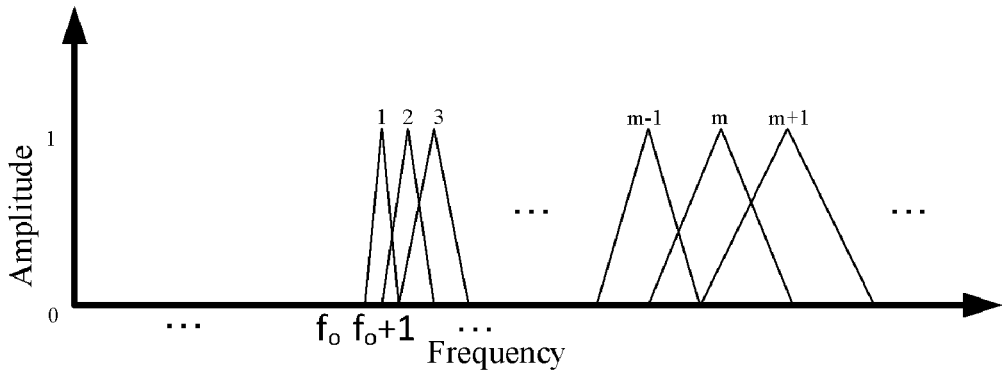
FIG. 3 is a graph of a group of a basis functions.

One frequency compression scheme used by some enhancement systems combines a frequency compression with a frequency transposition. In these enhancement systems, an enhancement controller may be programmed to derive a compressed high frequency component. In some enhancement systems, equation 1 is used, where $C_m$ is the $$C_m = g_m \sum_{k=1}^{N} |S_k| \varphi_m(k) \qquad \text{(Equation 1)}$$

amplitude of compressed high frequency component, $g_m$ is a gain factor, $S_k$ is the frequency component of original speech signal, $\phi_m(k)$ is compression basis functions, and k is the discrete frequency index. While any shape of window function may be used as non-linear compression basis function ($\phi_m(k)$), including triangular, Hanning, Hamming, Gaussian, Gabor, or wavelet windows, for example, FIG. 3 shows a group of typical 50% overlapping basis functions used in some enhancement systems. These triangular shaped basis functions have lower frequency basis functions covering narrower frequency ranges and higher frequency basis functions covering wider frequency ranges.

The frequency components are then mapped to a lower frequency range. In some enhancement systems, an enhancement controller may be programmed or configured to map $$\begin{cases} \hat{S}_k = S_k & k = 1, 2, \ldots, f_o \\ \hat{S}_k = \dfrac{C_{k-f_o}}{|S_k|} S_k & k = f_o + 1, f_o + 2, \ldots, N \end{cases} \qquad \text{(Equation 2)}$$

the frequencies to the functions shown in equation 2. In equation 2, $\hat{S}_k$ is the frequency component of compressed speech signal and $f_o$ is the cutoff frequency index. Based on this compression scheme, all frequency components of the original speech below the cutoff frequency index $f_o$ remain unchanged or substantially unchanged. Frequency components from cutoff frequency "A" to the Nyquist frequency are compressed and shifted to a lower frequency range. The frequency range extends from the lower cutoff frequency "A" to the upper cutoff frequency "B" which also may comprise the upper limit of a telephone or communication pass-band. In this enhancement system, higher frequency components have a higher compression ratio and larger frequency shifts than the frequencies closer to upper cutoff frequency "B." These enhancement systems improve the intelligibility and/or perceptual quality of a speech signal because those frequencies above cutoff frequency "B" carry significant consonant information, which may be critical for accurate speech recognition.

To maintain a substantially smooth and/or a substantially constant auditory background, an adaptive high frequency gain adjustment may be applied to the compressed signal. In FIG. 1, a gain controller 106 may apply a high frequency adaptive control to the compressed signal by measuring or estimating an independent extraneous signal such as a background noise signal in real time, near real time or delayed time through a noise detector 108. The noise detector 108 detects and may measure and/or estimate background noise. The background noise may be inherent in a communication line, medium, logic, or circuit and/or may be independent of a voice or speech signal. In some enhancement systems, a substantially constant discernable background noise or sounds is maintained in a selected bandwidth, such as from frequency "A" to frequency "B" of the telephone or communication bandwidth.

Figure 4:
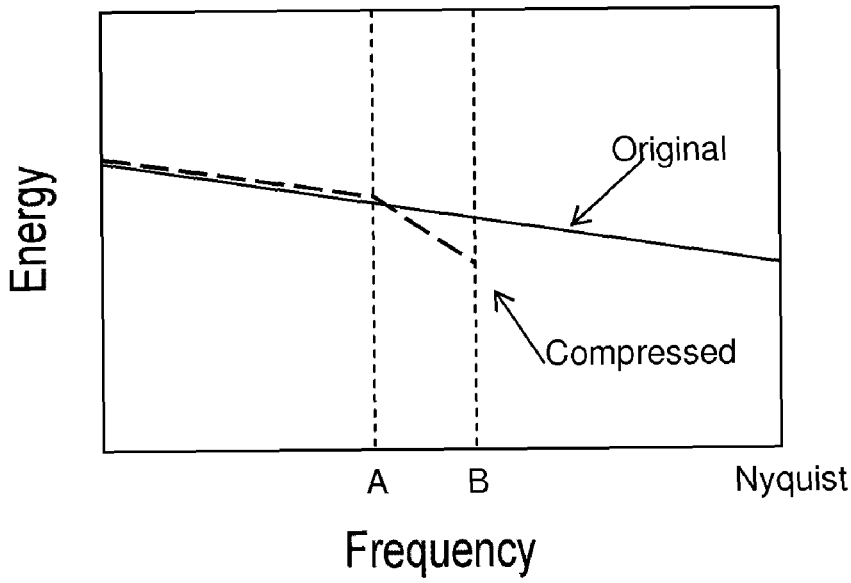
FIG. 4 is a graph of an original illustrative speech signal and a compressed portion of that signal.

The gain controller 106 may be programmed to amplify and/or attenuate only the compressed spectral signal that in some applications includes noise according to the function shown in equation 3. In equation 3, the output gain $g_m$ is derived by:

$$g_m = |N_{f_O+m}| \Big/ \sum_{k=1}^{N} |N_k| \varphi_m(k) \qquad \text{(Equation 3)}$$

$$m = 1, 2, \ldots, M$$

where $N_k$ is the frequency component of input background noise. By tracking gain to a measured or estimated noise level, some enhancements systems maintain a noise floor across a compressed and uncompressed bandwidth. If noise is sloped down as frequency increases in the compressed frequency band, as shown in FIG. 4, the compressed portion of the signal may have less energy after compression than before compression. In these conditions, a proportional gain may be applied to the compressed signal to adjust the slope of the compressed signal. In FIG. 4 the slope of the compressed signal is adjusted so that it is substantially equal to the slope of the original signal within the compressed frequency band. In some enhancement systems, the gain controller 106 will multiply the compressed signal shown in FIG. 4 with a multiplier that is equal to or greater than one and changes with the frequency of the compressed signal. In FIG. 4, the incremental differences in the multipliers across the compressed bandwidth will have a positive trend.

Figure 5:
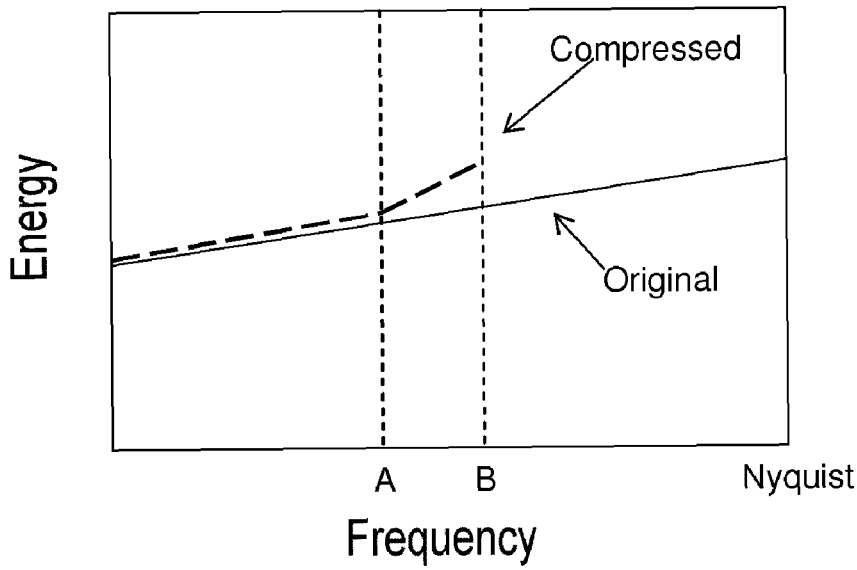
FIG. 5 is a second graph of an original illustrative speech signal and a compressed portion of that signal.

To overcome the effects of an increasing background noise in the compressed signal band shown in FIG. 5, the gain controller 106 may dampen or attenuate the gain of the compressed portion of the signal. In these conditions, the strength of the compressed signal will be dampened or attenuated to adjust the slope of the compressed signal. In FIG. 5, the slope is adjusted so that it is substantially equal to the slope of the original signal within the compressed frequency band. In some enhancement systems, the gain controller 106 will multiply the compressed signal shown in FIG. 5 with a multiplier that is equal to or less than one but greater than zero. In FIG. 5, the multiplier changes with the frequency of the compressed signal. Incremental difference in the multiplier across the compressed bandwidth shown in FIG. 5 will have a negative trend.

Figure 6:
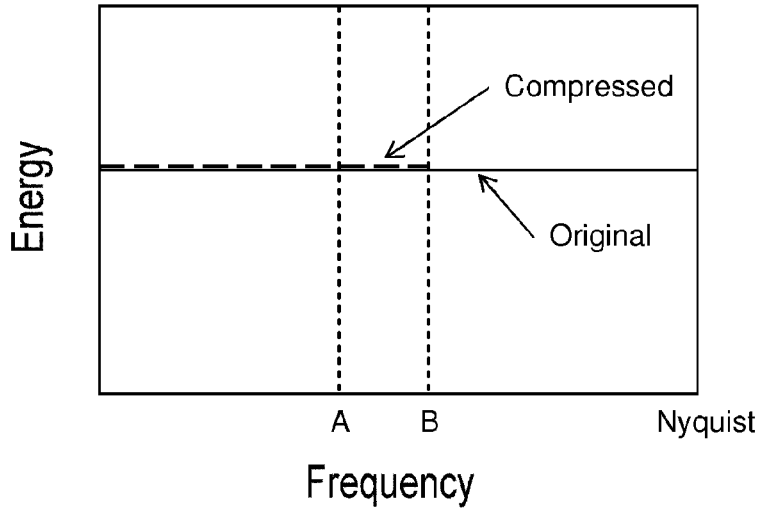
FIG. 6 is a third graph of an original illustrative speech signal and a compressed portion of that signal.

When background noise is equal or almost equal across all frequencies of a desired bandwidth, as shown in FIG. 6, the gain controller 106 will pass the compressed signal without amplifying or dampening it. In some enhancement systems, a gain controller 106 is not used in these conditions, but a preconditioning controller that normalizes the input signal will be interfaced on the front end of the speech enhancement system to generate the original input speech segment.

To minimize speech loss in a band limited frequency range, the cutoff frequencies of the enhancement system may vary with the bandwidth of the communication systems. In some telephone systems having a bandwidth up to approximately 3,600 Hz, the cutoff frequency may lie between about 2,500 Hz and about 3,600 Hz. In these systems, little or no compression occurs below the lowest cutoff frequency, while higher frequencies are compressed and transposed more strongly. As a result, lower harmonic relations that impart pitch and may be perceived by the human ear are preserved.

Further alternatives to the voice enhancement system may be achieved by analyzing a signal-to-noise ratio (SNR) of the compressed and uncompressed signals. This alternative recognizes that the second format peaks of vowels are predominately located below the frequency of about 3,200 Hz and their energy decays quickly with higher frequencies. This may not be the case for some unvoiced consonants, such as /s/, /f/, /t/, and /tʃ/. The energy that represents the consonants may cover a higher range of frequencies. In some systems, the consonants may lie between about 3,000 Hz to about 12,000 Hz. When high background noise is detected, which may be detected in a vehicle, such as a car, consonants may be likely to have higher Signal-to-Noise Ratio in the higher frequency band than in the lower frequency band. In this alternative, the average SNR in the uncompressed range $SNR_{A\text{-}B}$ uncompressed lying between cutoff frequencies "A" and "B" is compared to the average SNR in the would-be-compressed frequency range $SNR_{A\text{-}B\ compressed}$ lying between cutoff frequencies "A" and "B" by a controller. If the average $SNR_{A\text{-}B\ uncompressed}$ is higher than or equal to the average $SNR_{A\text{-}B\ compressed}$ then no compression occurs. If the average $SNR_{A\text{-}B\ uncompressed}$ is less than the average $SNR_{A\text{-}B\ compressed}$, a compression, and in some case, a gain adjustment occurs. In this alternative A-B represents a frequency band. A controller in this alternative may comprise a processor that may regulate the spectral compressor 104 through a wireless or tangible communication media such as a communication bus.

Another alternative speech enhancement system and method compares the amplitude of each frequency component of the input signal with a corresponding amplitude of the compressed signal that would lie within the same frequency band through a second controller coupled to the spectral compressor. In this alternative shown in $$|\hat{S}_{k\ output}| = \max(|S_k|, |\hat{S}_k|) \qquad \text{(Equation 4)}$$

equation 4, the amplitude of each frequency bin lying between cutoff frequencies "A" and "B" is chosen to be the amplitude of the compressed or uncompressed spectrum, whichever is higher.

Each of the controllers, systems, and methods described above may be encoded in a signal bearing medium, a computer readable medium such as a memory, programmed within a device such as one or more integrated circuits, or processed by a controller or a computer. If the methods are performed by software, the software may reside in a memory resident to or interfaced to the spectral compressor 104, noise detector 108, gain adjuster 106, frequency to time transformer 110 or any other type of non-volatile or volatile memory interfaced, or resident to the speech enhancement logic. The memory may include an ordered listing of executable instructions for implementing logical functions. A logical function may be implemented through digital circuitry, through source code, through analog circuitry, or through an analog source such through an analog electrical, or optical signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any apparatus that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

Figure 7:
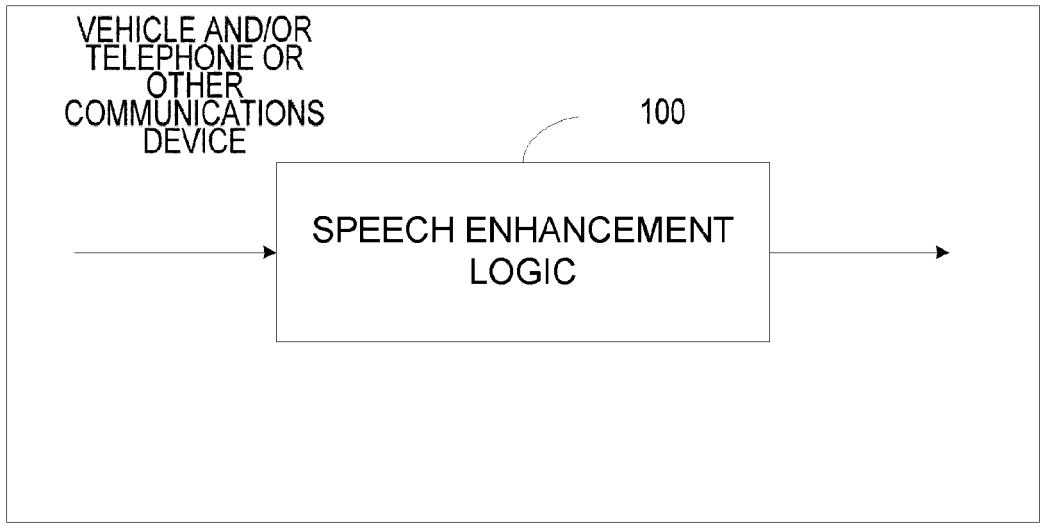
FIG. 7 is a block diagram of the speech enhancement system within a vehicle and/or telephone or other communication device.
Figure 8:
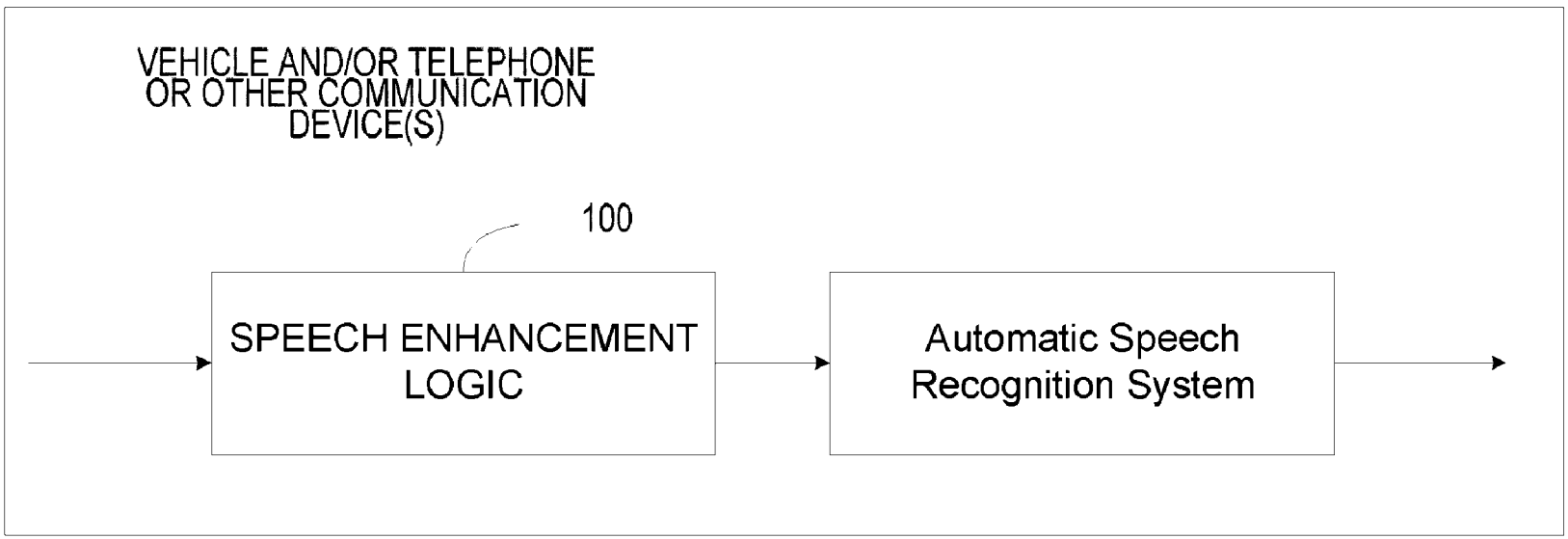
FIG. 8 is a block diagram of the speech enhancement system coupled to an Automatic Speech Recognition System in a vehicle and/or a telephone or other communication device.

The speech enhancement logic 100 is adaptable to any technology or devices. Some speech enhancement systems interface or are coupled to a frequency to time transformer 110 as shown in FIG. 1. The frequency to time transformer 110 may convert signal from frequency domain to time domain. Since some time-to-frequency transformers may process some or all input frequencies almost simultaneously, some frequency-to-time transformers may be programmed or configured to transform input signals in real time, almost real time, or with some delay. Some speech enhancement logic or components interface or couple remote or local ASR engines as shown in FIG. 8 (shown in a vehicle that may be embodied in telephone logic or vehicle control logic alone). The ASR engines may be embodied in instruments that convert voice and other sounds into a form that may be transmitted to remote locations, such as landline and wireless communication devices that may include telephones and audio equipment and that may be in a device or structure that transports persons or things (e.g., a vehicle) or stand alone within the devices. Similarly, the speech enhancement may be embodied in personal communication devices including walkie-talkies, Bluetooth enabled devices (e.g., headsets) outside or interfaced to a vehicle with or without ASR as shown in FIG. 7.

The speech enhancement logic is also adaptable and may interface systems that detect and/or monitor sound wirelessly or by an electrical or optical connection. When certain sounds are detected in a high frequency band, the system may disable or otherwise mitigate the enhancement logic to prevent the compression, mapping, and in some instances, the gain adjustment of these signals. Through a bus, such as a communication bus, a noise detector may send an interrupt (hardware of software interrupt) or message to prevent or mitigate the enhancement of these sounds. In these applications, the enhancement logic may interface or be incorporated within one or more circuits, logic, systems or methods described in "System for Suppressing Rain Noise," U.S. Ser. No. 11/006,935, each of which is incorporated herein by reference.

The speech enhancement logic improves the intelligibility of speech signals. The logic may automatically identify and compress speech segments to be processed. Selected voiced and/or unvoiced segments may be processed and shifted to one or more frequency bands. To improve perceptual quality, adaptive gain adjustments may be made in the time or frequency domains. The system may adjust the gain of only some of or the entire speech segments with some adjustments based on a sensed or estimated signal. The versatility of the system allows the logic to enhance speech before it is passed or processed by a second system. In some applications, speech or other audio signals may be passed to remote, local, or mobile ASR engine that may capture and extract voice in the time and/or frequency domains. Some speech enhancement systems do not switch between speech and silence or voiced and unvoiced segments and thus are less susceptible the squeaks, squawks, chirps, clicks, drips, pops, low frequency tones, or other sound artifacts that may be generated within some speech systems that capture or reconstruct speech.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A system, comprising: a computer processor;

a frequency transformer configured to convert a speech signal into a spectrum of frequencies; and a spectral compressor regulated by the computer processor and coupled with the frequency transformer, where the spectral compressor is configured to define a lower cutoff frequency within a frequency passband having a passband upper frequency limit, where the spectral compressor is configured to compress a pre-selected high frequency band of the speech signal between the lower cutoff frequency and a frequency component above the passband upper frequency limit, and where the spectral compressor is configured to map the compressed high frequency band to a lower frequency range below the passband upper frequency limit in response to a determination that a signal-to-noise ratio of the speech signal in the lower frequency range before compression is less than a signal-to-noise ratio of the speech signal in the lower frequency range after compression.

2. The system of claim 1, where the spectral compressor is further configured to output the speech signal without compression of the pre-selected high frequency band in response to a determination that the signal-to-noise ratio of the speech signal in the lower frequency range before compression is higher than the signal-to-noise ratio of the speech signal in the lower frequency range after compression.

3. The system of claim 1, further comprising a gain controller configured to apply a variable gain to the compressed high frequency band based on a background noise level present in the speech signal.

4. The system of claim 3, where the gain controller is configured to select a level for the variable gain based on a slope of a noise floor present in the compressed high frequency band of the speech signal and a slope of a noise floor present in an uncompressed frequency portion of the speech signal.

5. The system of claim 3, where the gain controller is configured to select a level for the variable gain that substantially aligns a slope of a noise floor present in the compressed high frequency band with a slope of a noise floor present in an uncompressed frequency portion of the speech signal.

6. The system of claim 1, where the pre-selected high frequency band comprises a larger range of frequencies than the lower frequency range.

7. The system of claim 1, where the spectral compressor is configured to apply a non-linear compression basis function to the speech signal.

8. The system of claim 1, where the spectral compressor is configured to compress a first portion of the speech signal above the lower cutoff frequency without compression of a second portion of the speech signal below the lower cutoff frequency.

9. The system of claim 1, where the speech signal comprises a highest frequency component that is greater than a passband upper frequency limit, and where the spectral compressor is configured to compress and map at least a portion of the speech signal above the passband upper frequency limit to the lower frequency range below the passband upper frequency limit.

10. The system of claim 1, where the pre-selected high frequency band comprises a portion of the speech signal between about 2,800 Hz and a highest frequency component that is higher than 5,000 Hz, and where the spectral compressor is configured to compress and map the compressed high frequency band to the lower frequency range between about 2,800 Hz and about 3,600 Hz.

11. A method, comprising:

identifying a frequency passband having a passband upper frequency limit;

defining a lower cutoff frequency within the frequency passband;

receiving a speech signal having a frequency spectrum, a highest frequency component of which is greater than the passband upper frequency limit;

calculating a signal-to-noise ratio of the speech signal in a first frequency range between the lower cutoff frequency and the passband upper frequency limit; and compressing a portion of the speech signal spectrum in a second frequency range between the lower cutoff frequency and the highest frequency component of the speech signal into the first frequency range between the lower cutoff frequency and the passband upper frequency limit in response to a determination that the signal-to-noise ratio of the speech signal in the first frequency range before compression is less than a signal-to-noise ratio of the speech signal in the first frequency range after compression.

12. The method of claim 11, further comprising outputting the speech signal without compression of the second frequency range in response to a determination that the signal-to-noise ratio of the speech signal in the first frequency range before compression is higher than the signal-to-noise ratio of the speech signal in the first frequency range after compression.

13. The method of claim 11, further comprising applying a variable gain to the compressed speech signal spectrum based on a background noise level present in the speech signal.

14. The method of claim 13, further comprising selecting a level for the variable gain based on a slope of a noise floor present in the compressed speech signal spectrum of the speech signal and a slope of a noise floor present in an uncompressed frequency portion of the speech signal.

15. The method of claim 13, further comprising selecting a level for the variable gain that substantially aligns a slope of a noise floor present in the compressed speech signal spectrum with a slope of a noise floor present in an uncompressed frequency portion of the speech signal.

16. The method of claim 11, where the act of compressing comprises regulating a spectral compressor by a computer processor.

17. A non-transitory computer-readable medium with instructions stored thereon, where the instructions are executable by a processor to cause the processor to perform the steps of:

identifying a frequency passband having a passband upper frequency limit;

defining a lower cutoff frequency within the frequency passband;

receiving a speech signal having a frequency spectrum, a highest frequency component of which is greater than the passband upper frequency limit;

calculating a signal-to-noise ratio of the speech signal in a first frequency range between the lower cutoff frequency and the passband upper frequency limit; and compressing a portion of the speech signal spectrum in a second frequency range between the lower cutoff frequency and the highest frequency component of the speech signal into the first frequency range between the lower cutoff frequency and the passband upper frequency limit in response to a determination that the signal-to-noise ratio of the speech signal in the first frequency range before compression is less than a signal-to-noise ratio of the speech signal in the first frequency range after compression.

18. The non-transitory computer-readable medium of claim 17, further comprising instructions executable by the processor to cause the processor to perform the step of outputting the speech signal without compression of the second frequency range in response to a determination that the signal-to-noise ratio of the speech signal in the first frequency range before compression is higher than the signal-to-noise ratio of the speech signal in the first frequency range after compression.

19. The non-transitory computer-readable medium of claim 17, further comprising instructions executable by the processor to cause the processor to perform the step of applying a variable gain to the compressed speech signal spectrum based on a background noise level present in the speech signal.

20. The non-transitory computer-readable medium of claim 19, further comprising instructions executable by the processor to cause the processor to perform the step of selecting a level for the variable gain based on a slope of a noise floor present in the compressed speech signal spectrum of the speech signal and a slope of a noise floor present in an uncompressed frequency portion of the speech signal.

21. The non-transitory computer-readable medium of claim 19, further comprising instructions executable by the processor to cause the processor to perform the step of selecting a level for the variable gain that substantially aligns a slope of a noise floor present in the compressed speech signal spectrum with a slope of a noise floor present in an uncompressed frequency portion of the speech signal.

* * * * *